US007003802B2

(12) United States Patent
Broersma

(10) Patent No.: US 7,003,802 B2
(45) Date of Patent: Feb. 28, 2006

(54) FACE MASK WITH DETACHABLE EYE SHIELD

(75) Inventor: Lester Broersma, San Diego, CA (US)

(73) Assignee: JT USA, LLC, Chula Vista, CA (US)

( * ) Notice: Subject to any disclaimer, the term of this patent is extended or adjusted under 35 U.S.C. 154(b) by 0 days.

(21) Appl. No.: 10/128,982

(22) Filed: Apr. 23, 2002

(65) Prior Publication Data

US 2005/0150028 A1 Jul. 14, 2005

Related U.S. Application Data

(60) Provisional application No. 60/285,453, filed on Apr. 23, 2001.

(51) Int. Cl.
*A42B 1/00* (2006.01)

(52) U.S. Cl. ..... 2/9; 2/424; 2/427

(58) Field of Classification Search ..... 2/423, 2/424, 425, 427, 431, 435, 450, 429, 10, 2/9, 443, 441
See application file for complete search history.

(56) References Cited

U.S. PATENT DOCUMENTS 2,799,862 A * 7/1957 Rowe ..... 2/9
3,050,736 A * 8/1962 Malcom, Jr. ..... 2/9
3,259,908 A * 7/1966 Simpson et al. ..... 2/9
3,274,614 A * 9/1966 Boyer ..... 2/427
3,783,452 A * 1/1974 Benson et al. ..... 2/6.4
3,789,428 A * 2/1974 Martin ..... 2/9
4,462,119 A * 7/1984 Rudd ..... 2/424
5,148,550 A * 9/1992 Hodgkinson et al. ..... 2/424
RE34,699 E * 8/1994 Copeland et al. ..... 2/419
6,301,719 B1 * 10/2001 Goodhand et al. ..... 2/422
6,381,749 B1 * 5/2002 Cyr ..... 2/9
6,718,561 B1 * 4/2004 Dondero ..... 2/436

* cited by examiner

*Primary Examiner*—Rodney M. Lindsey
(74) *Attorney, Agent, or Firm*—Keisling Pieper & Scott PLC; David B. Pieper; Trent C. Keisling

(57) ABSTRACT

In a face mask for use in the practice of paint-ball games or other such activities requiring effective shielding of the face, a large unitary lens is applied to an aperture extending from the brow to the chin and from one temple to the other. The lens is secured by a pair of releasable clips that can be quickly manipulated for cleaning or replacement of the lens in a matter of seconds. A semi-conical breath deflector extends behind the lens from the nose bridge to the base of the lens channeling the breath away from the lens and towards ventilating slits in the base of the mask. The slant of the deflector avoids any obstruction of the field of vision such as created by the lens frame of conventional goggles and face masks.

4 Claims, 4 Drawing Sheets

FACE MASK WITH DETACHABLE EYE SHIELD

PRIOR APPLICATION

This application claims the benefit of U.S. Provisional Patent Application Ser. No. 60/285,453 filed Apr. 23, 2001.

FIELD OF THE INVENTION

This invention relates to goggles and protective masks, and more particularly to face shielding devices used in the practice of some sporting activities such as skiing, motor cycling and paint-ball war games.

BACKGROUND OF THE INVENTION

Masks and face shields of the prior art used in connection with certain sporting activities such as skiing, motorcycling and paint-ball war games often suffer from a reduced field of vision and poor visibility due to fogging and soiling of the eye shield. During activities such as motor cross and paint-ball war games, the lens acting as an eye shield is subject to scratching and soiling by mud or paint splashes which cannot be effectively wiped out, and may require replacement of the eye shield. Players may also wish to interchange shields depending on playing conditions. For example, a tinted or polarizing shield may be preferred in bright sunlight.

Because of the rigorous nature of play, the shield attachment mechanism must be rugged and non-bulky.

SUMMARY OF THE INVENTION

The principal and secondary objects of this invention are to provide a face shield including a wide angle lens which is protected against fogging by the breath of the user, imposes no restriction upon the field of vision, and can be quickly replaced by a simple one-hand manipulation in the course of a competition or game.

It is a further object of the invention to provide a simple to operate, rugged, sleek and inexpensive to manufacture mechanism to releasably attach eye shields to masks.

These and other valuable objects are achieved by providing a face mask made of a soft pliable plastic material having a broad central opening extending from the brow to the chin and from one temple to another that is covered by a single arcuate lens devoid of any frame which could restrict the field of vision. A conical breath deflector extends over the nose and downward, toward the chin of the wearer in intimate contact with the cheeks in order to deflect the breath away from the lens and toward a series of slits in the neck area of the mask. The lens is attached to the temple areas of the mask by a simple mechanism that allows for single-handed removal. Improvements provide a latch mechanism which mounts on the inside surface of the mask and a self-biasing, snap-in-place function.

DESCRIPTION OF THE PREFERRED EMBODIMENT OF THE INVENTION

Figure 1:
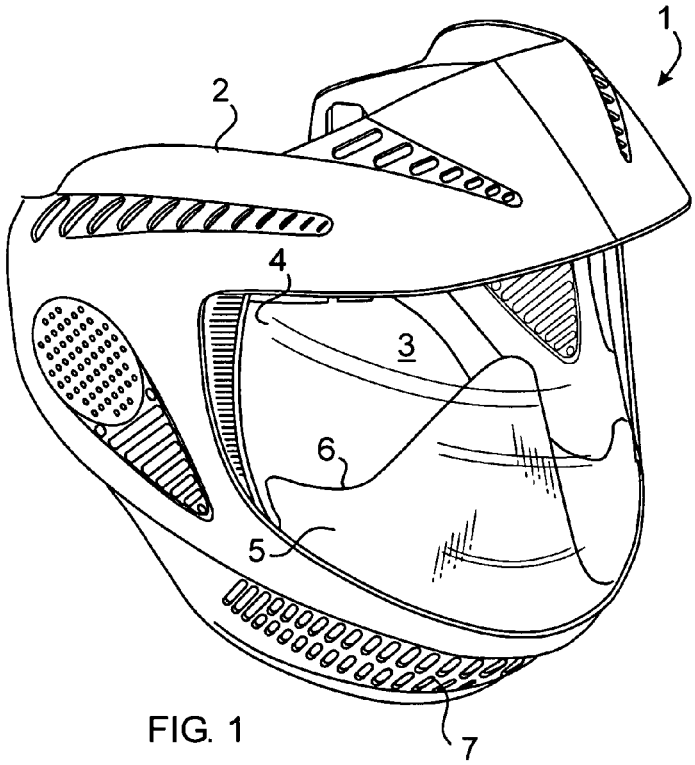
FIG. 1 is a perspective view of a protective face mask according to the invention.

Referring now to the drawing, there is shown in FIG. 1, a face mask 1 which comprises a hollow frame 2 shaped and dimensioned to protect the forehead, ears, chin and, partially, the neck of a user. A median arcuate aperture 3 is covered by a unitary plastic transparent lens 4. The aperture extends from the brow to the chin of the user and from one temple to the other. A breath deflector 5 having a generally semi-conical shape extends from the area of the nose bridge of the user down to the lower edge of the aperture at the level of the chin. The breath deflector upper edge 6 is contoured to intimately contact the nose and cheeks of the user so that his or her breath is deflected toward a series of slits 7 in the lower part of the frame 2.

Due to the broad dimension of the aperture 3 and the slanted orientation of the breath deflector, the field of vision is practically unobstructed. The upper part of the frame 2 extends forward to form an eye shade 8.

Figure 2:
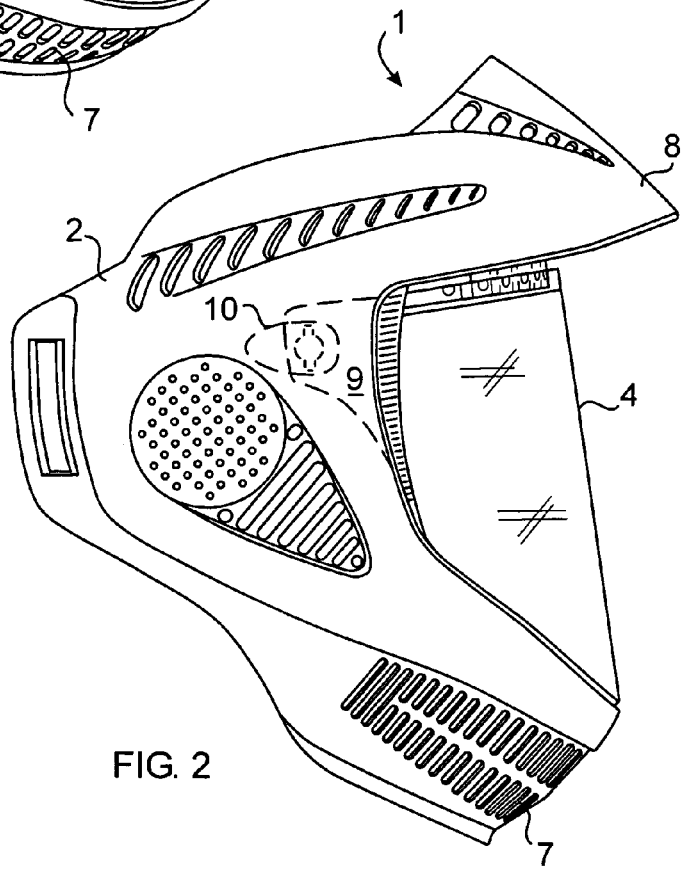
FIG. 2 is a side view thereof.

As more specifically illustrated in dotted line in FIG. 2, the lens is removably attached to the inner temple area 9 of the frame by means of a easily and quickly manipulable locking mechanism 10. Alternately, the attachment of the lens 4 can also be implemented on the outer side of the temple areas. Inner implementation provides greater protection from inadvertent disengaging of the lens from outside causes.

Figure 3:
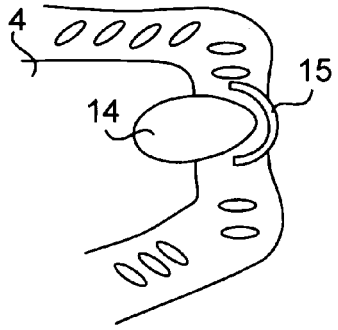
FIGS. 3–5 are schematical views of a first eye shield attachment mechanism.
Figure 4:
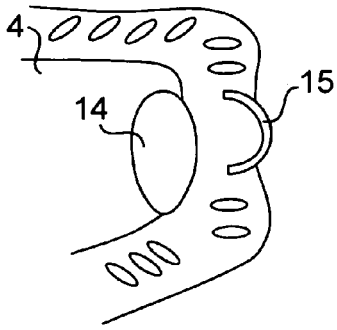
Figure 5:
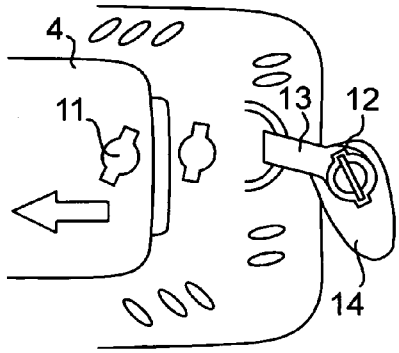

In a first embodiment of the lens attachment mechanism 10 illustrated in FIGS. 3–5, the rear edge of the lens 4 is provided with a keyed hole 11 which is shaped and dimensioned to be engaged by a rotatable nib 12 mounted on a flap 13 hingedly secured to the temple area of the mask. The nib 12 is associated with an oval button or lever 14 which can be easily rotated with the thumb from a vertical unlocked position shown in FIG. 4 to a locked position illustrated in FIG. 3. An arcuate ridge 15 extending around the tip of the lever 14 from the surface of the mask, prevents the lever from rotating away from its locked position. The ridge can be conveniently depressed with the nail of the thumb or with the tip of another finger to free the lever due to the soft flexible material used in the fabrication of the mask.

Figure 8:
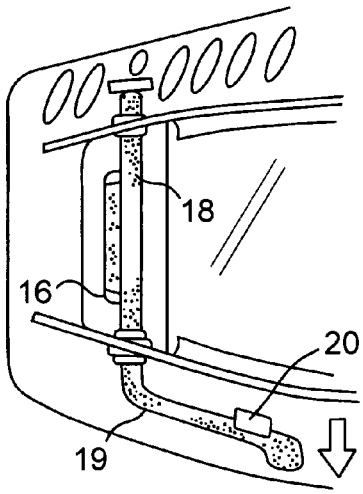
FIGS. 6–8 are schematical views of a second eye shield attachment mechanism.
Figure 7:
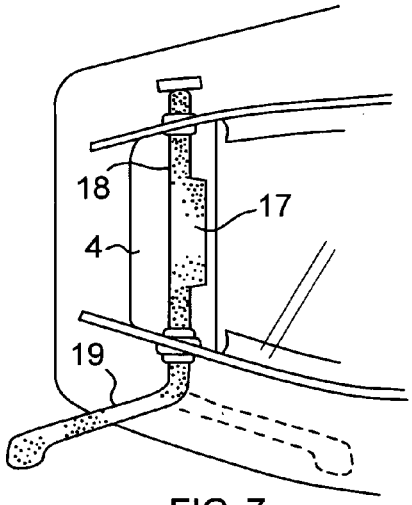
Figure 6:
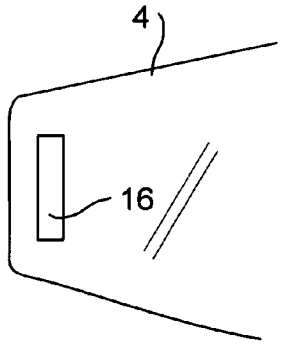

In the second embodiment of the lock mechanism 10 illustrated in FIGS. 6–8, the rear edge of the lens 4 is provided with a slot 16 which is shaped and dimensioned to be engaged by a cam 17 extending radially from a shaft 18 rotatively secured in a vertical position against the temple area of the mask. A small handle 19 projecting angularly from the shaft 18 is used to rotate the cam 17 into the slot 16. A nib 20 on the mask surface having a concave under surface and is used to immobilize the lever in the locked position. The lever can be freed from its locked position by a downward movement away from the nib 20.

Figure 11:
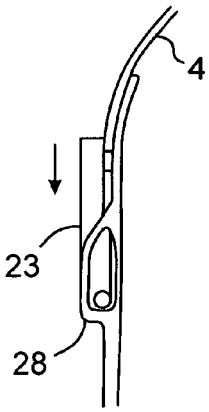
FIGS. 9–11 are schematical views of a third eye shield attachment mechanism.
Figure 10:
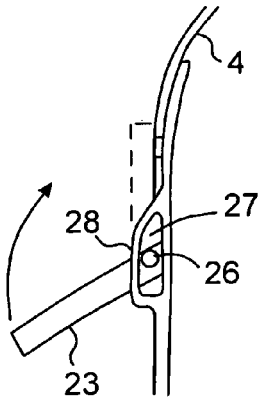
Figure 9:
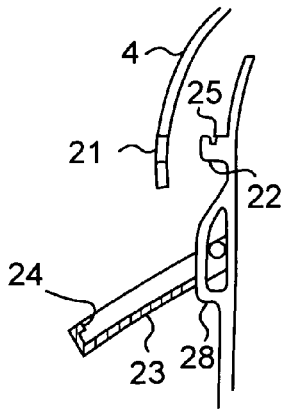

In a third embodiment of the locking mechanism 10 illustrated in FIGS. 9–11, the rear edge of the lens 4 is provided with a small hole 21 dimensioned to engage a nib 22 protruding from the temple area of the mask. A locking cover 23 hinged to the mask surface immediately behind the nib 22 can be flipped over the edge of the lens engaged by the nib 22, then slid back until a ledge 24 in the distal end of the cover engages into a slot 25 in the forward side of the nib. The hinged part of the cover comprises a pin 26 slidingly engaged into a pair of slots 27 practiced into protrusions in the surface of the mask.

Figure 12:
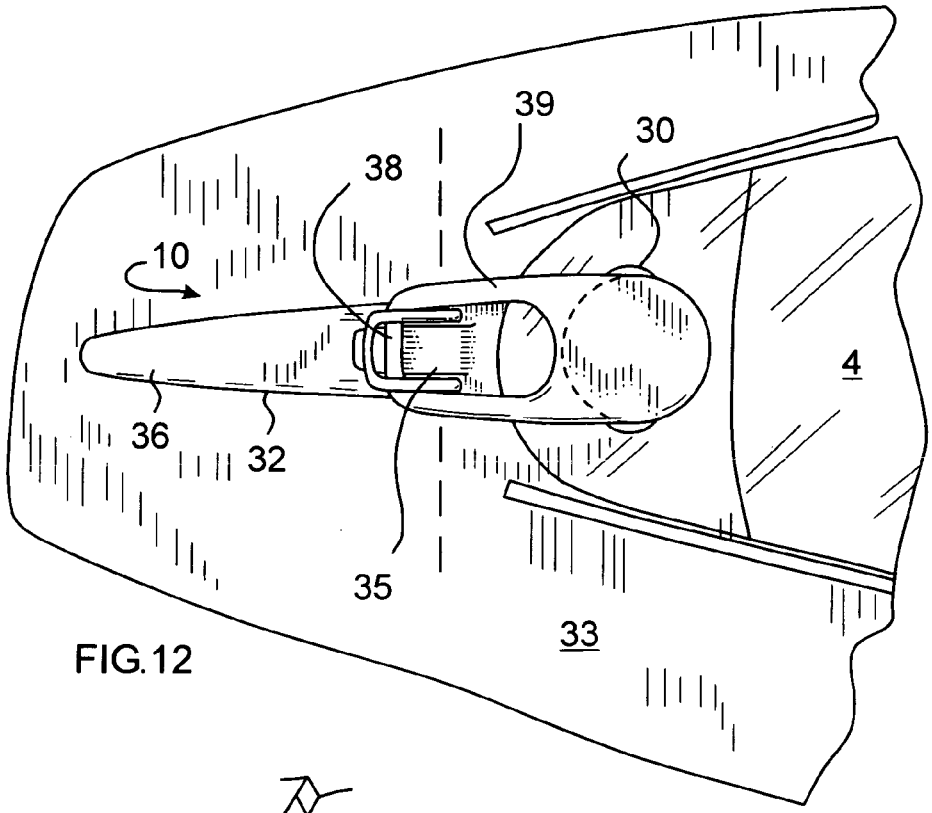
FIGS. 12–13 are schematical views of a fourth eye shield attachment mechanism.
Figure 13:
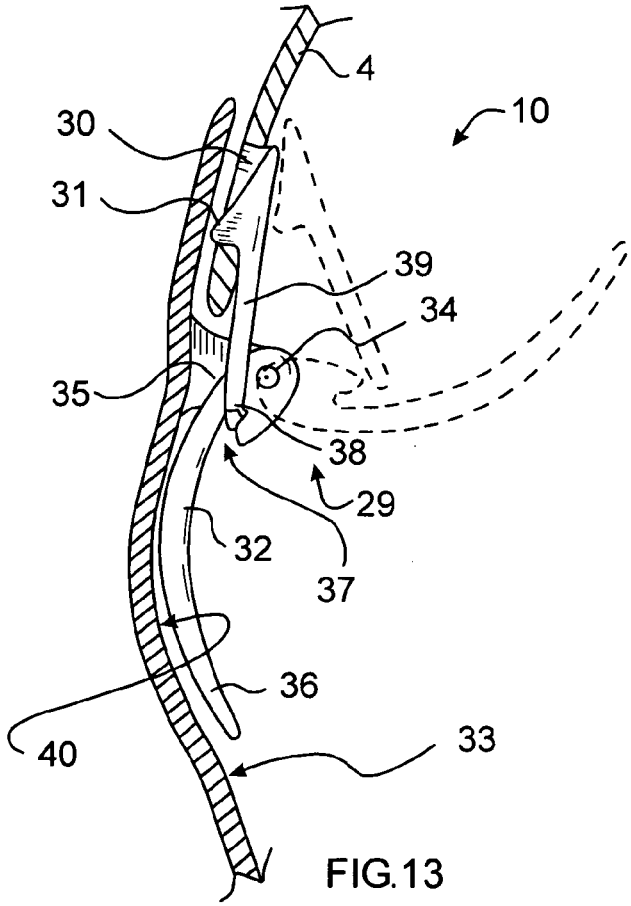

In a fourth embodiment of the locking mechanism 10 illustrated in FIGS. 12–13, the rear edge of the lens 4 is provided with a hole 30 shaped and dimensioned to engage a nib 31 protruding laterally from the hook end of an articulated latch 29. The latch body has a lever section 32 hingedly attached to the inner surface 33 of the mask frame at a hinge post 34 engaging an inwardly projecting tang 35. The lever section has a handle 36 and a crook 37 hingedly engaging the loop end 38 of a strap section 39 of the latch. A laterally extending depression 40 in the inner surface of the frame provides for a non-obtrusive locked position for the latch handle 36.

Figure 16:
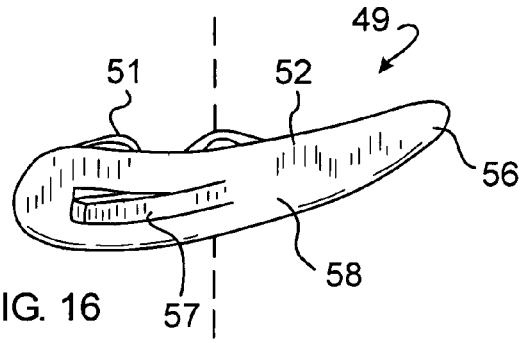
FIGS. 14–16 are schematical view of a fifth eye shield attachment mechanism.
Figure 14:
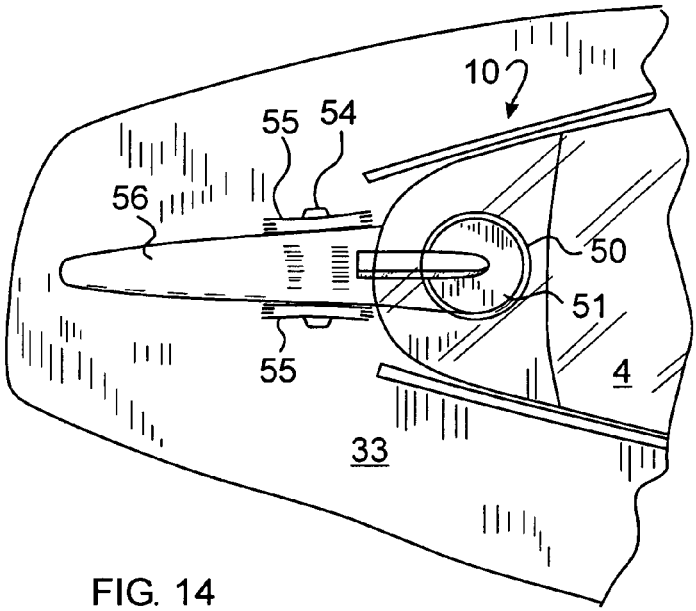
Figure 15:
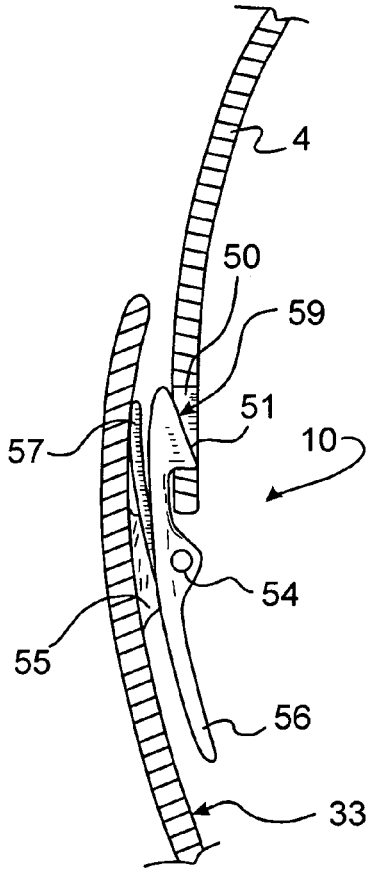

In a fifth embodiment of the locking mechanism 10 illustrated in FIGS. 14–16, the rear edge of the lens 4 is provided with a hole 50 shaped and dimensioned to engage a nib 51 protruding inwardly or medially from the hook end of a spring-loaded auto-locking latch 49. The latch is formed from a generally oblong body 52 hingedly mounted as a lever to the inner surface 33 of the mask frame at a hinge post 54 penetrating a vertical post hole in the body between a straddling pair of tangs 55 inwardly projecting from the mask frame inner surface. The body has a handle end 56 opposite the nib end. A cantilevered spring prong 57 extends laterally from a lateral surface 58 of the body to contact the frame inner surface and thereby bias the nib end inwardly or medially toward a locked position. The nib has a sloped surface 59 to facilitate snapping the lens into place and automatically lock it.

By mounting the locking mechanism on the inside of the mask, it is protected from inadvertent unlocking through contact from outer contacts.

While the preferred embodiments of the invention have been described, modifications can be made and other embodiments may be devised without departing from the spirit of the invention and the scope of the appended claims.

What is claimed is:

1. A protective mask for partially covering the human face and head comprises:

a hollow frame having an inner and an outer surface;

a latch mechanism mounted to said inner surface for releasably attaching to an eye shield;

wherein said latch mechanism comprises:

an oblong body having a first hook end and an opposite handle;

said hook end being shaped and dimensioned to releasably engage a slot in said eye shield;

said body is articulated having a lever section and a strap section; and said strap section has a loop end and an opposite end which forms said first hook end of said body.

2. The mask of claim 1, wherein said lever section has a crook end shaped and dimensioned to hingedly engage said loop end of said strap section.

3. The mask of claim 2, wherein said lever section has an end opposite from said crook end forming said handle end of said body.

4. A protective mask for partially covering the human face and head comprises:

a hollow frame having an inner and an outer surface;

a latch mechanism mounted to said inner surface for releasably attaching to an eye shield;

wherein said latch mechanism comprises:

an oblong body having a first hook end and an opposite handle;

said hook end being shaped and dimensioned to releasably engage a slot in said eye shield; and wherein said latch mechanism further comprises:

said body having a spring arm extending from a lateral surface of said body proximate to said hook end thereby medially biasing said hook end.

* * * * *